US006773661B2

(12) United States Patent
Hayaishi et al.

(10) Patent No.: US 6,773,661 B2
(45) Date of Patent: Aug. 10, 2004

(54) FREE-CUTTING STEEL

(75) Inventors: Masakazu Hayaishi, Nagoya (JP); Yutaka Kurebayashi, Nagoya (JP)

(73) Assignee: Daido Steel Co., Ltd., Nagoya (JP)

( * ) Notice: Subject to any disclaimer, the term of this patent is extended or adjusted under 35 U.S.C. 154(b) by 0 days.

(21) Appl. No.: 10/157,880

(22) Filed: May 31, 2002

(65) Prior Publication Data

US 2003/0072672 A1 Apr. 17, 2003

(30) Foreign Application Priority Data

Jun. 1, 2001 (JP) ..... 2001-167122
Apr. 30, 2002 (JP) ..... 2002-128943

(51) Int. Cl.[7] ..... C22C 38/14; C22C 38/06
(52) U.S. Cl. ..... 420/87; 420/84
(58) Field of Search ..... 420/84, 88, 87

(56) References Cited

U.S. PATENT DOCUMENTS 4,279,646 A * 7/1981 Kato et al. ..... 420/83

* cited by examiner

*Primary Examiner*—Deborah Yee
(74) *Attorney, Agent, or Firm*—Varndell & Varndell, PLLC

(57) ABSTRACT

Disclosed is a free-cutting steel containing Ti- and/or Zr-carbosulfide as inclusion and having good machinability both in turning and drilling. The free-cutting steel consists essentially of, in mass %, C: 0.05–0.80%, Si: 0.01–2.5%, Mn: 0.1–3.5%, Ti+0.52Zr: 0.03–1.2%, S:0.015–0.6% and the balance of Fe and inevitable impurities, and is characterized in that the contents of Ti, Zr and S meet the condition of (Ti+0.52Zr)/S<2. The free-cutting steel may contain, in addition to the above basic alloy composition, Ca: 0.0005–0.02% and/or Mg: 0.0003–0.02%. The latter steel exhibits much more improved machinability.

7 Claims, No Drawings

FREE-CUTTING STEEL

BACKGROUND OF THE INVENTION

The present invention concerns a free-cutting steel. More specifically, the invention concerns a free-cutting steel having good machinability both in turning and drilling.

There are various steels having good machinability as a kind of machine structural steels such as Pb(lead)-free-cutting steel, S(sulfur)-free-cutting steel and Ca(calcium)-free-cutting steel. Pb-free-cutting steel is an excellent one in that it exhibits high machinability without damaging mechanical properties of the base steel. These days, however, in view of undesirable influence by Pb to the environment, use of Pb as a machinability improving element is often avoided and efforts are made to develop Pb-free or low Pb-content free-cutting steel.

As one of the free-cutting steels which do not rely on the machinability improving effect by Pb there is a steel which is so designed to have carbosulfide inclusions of Ti and/or Zr precipitated in the steel matrix. This kind of free-cutting steel has, though machinability in turning is good, a drawback that machinability in drilling is low, when compared with the others such as S-free-cutting steel.

The inventors conducted research on the above-mentioned free-cutting steel in which the carbosulfide of Ti and/or Zr (in the following description, represented by "Ti-carbosulfide", which mainly consists of a compound expressed as $Ti_4C_2S_2$) precipitated to improve the machinability in drilling with maintaining the inherent good machinability in turning. The inventors' discussion is as follows.

(1) As is well known, at cutting a steel with a tool free-cutting component in the steel melts or is softened due to the heat generation caused by friction and functions as the lubricant to decrease the resistance of friction between the edge of the tool and the part of the steel which is being cut, and thus, the cutting proceeds. In the case of turning the outer round surfaces friction heat is very large and therefore, even if the free-cutting components has a relatively high melting point, the component will melt or be softened. On the other hand, at drilling, even though the rotating rate of the tool is the same as that of turning, because diameter of a drill is usually small, heat generation by friction is small and therefore, if the melting point of the free-cutting component is relatively high, it will not melt or be softened.

(2) The fact that a free-cutting steel in which the Ti-carbosulfide precipitated, when compared with an S-free-cutting steel, exhibits good machinability in turning, while low machinability in drilling is considered to be based on the fact that melting point of the free-cutting component, Ti-carbosulfide, is higher than that of MnS, free-cutting component of ordinary S-free-cutting steel.

(3) The difference of hardness of the tools is mentioned as another difference in turning and drilling. Bites used in turning is usually made of cemented carbide, and the hardness of the tool is HV 2000 or higher. On the other hand, drills are made of a high-speed steel, and the hardness of the tool is HV around 1000, while hardness of the Ti-carbosulfide is in the range of HV 800–1000. If this free-cutting component is not sufficiently softened at cutting, it is evident that the drills will be abraded.

(4) Consequently, it is not possible to improve machinability in drilling with only the Ti-carbosulfide. It is considered that the above problem could be solved by having a suitable amount of MnS coexisted with the Ti-carbosulfide to enhance the machinability in drilling by MnS. MnS is so soft (about Hv150) that it may never damages drills, even if it is not softened by heat.

Based on the above discussion the inventors conducted research on the effect of the quantitative relation between the Ti and/or Zr and S on the machinability in turning and drilling. As the results, they discovered the fact that, as the contents in weight %, Ti[%] and 0.52Zr[%] are equivalent and that a ratio of Ti+0.52Zr to S less than 2 is useful for achieving favorable balance of the amounts of the Ti-carbosulfide formed and MnS formed.

The inventors also made research on suitable composition of MnS which offers good machinability in drilling. As the results it was found that MnS in which Ca and/or Mg is dissolved therein, i.e., (Mn,Ca,Mg)S is useful for improving the machinability in drilling.

SUMMARY OF THE INVENTION

The object of the present invention is to solve the problem residing in the free-cutting steel containing Ti-carbosulfide as the machinability-improving-inclusion and to provide a novel free-cutting steel having good machinability both in turning and drilling.

The free-cutting steel according to the present invention consists essentially of, in mass %, C: 0.05–0.80%, Si: 0.01–2.5%, Mn: 0.1–3.5%, Ti+0.52Zr: 0.03–1.2%, S:0.015–0.6% and the balance of Fe and inevitable impurities, and is characterized in that the contents of Ti, Zr and S meet the condition of (Ti+0.52Zr)/S<2.

DETAILED EXPLANATION OF THE PREFERRED EMBODIMENTS

The free-cutting steel according to the present invention may contain, in addition to the above mentioned basic alloy components, one or more of the elements enumerated below.

(1) one or both of Ca: 0.0005–0.02% and Mg: 0.0003–0.02%, (2) B: 0.0003–0.01%, (3) one or more of the group consisting of Cr: up to 3.5%, Ni: up to 4.0%, Cu: up to 2.0%, and Mo: up to 2.0%, (4) one or more of the group consisting of Se: 0.005–0.4%, Te: 0.005–0.1%, Pb: up to 0.4% and Bi: up to 0.4%, and (5) one or more of the group consisting of V: up to 0.2%, Nb: up to 0.2% and Ta: up to 0.5%.

In the present free-cutting steel two kinds of inclusions, Ti-carbosulfide and MnS, are formed in the matrix and coexist in dispersed state. In case where Ca and/or Mg presents in the steel, these elements are dissolved in MnS and therefore, the latter inclusion is expressed as (Mn,Ca,Mg)S. As understood from the above explanation the latter inclusion, MnS or (Mn,Ca,Mg)S, is the inclusion mainly for improving the machinability in drilling and Ti-carbosulfide is the inclusion mainly for improving the machinability in turning.

In order to attain coexistence of the two kinds of inclusions it is necessary that the relation, (Ti+0.52Zr)/S<2, in the amounts of Ti and Zr, and S is established. If this relation is not established, in other words, the amount of S to the amount of (Ti+0.52Zr) is not sufficiently large, major portion of S is fixed as carbosulfide of Ti, and MnS or (Mn,Ca,Mg)S will not be formed at all or, even if formed, in an insufficient amount, and thus, the machinability in drilling can not be improved.

The coefficient "0.52" is a value obtained by dividing 47.9, atomic weight of Ti, by 91.2, atomic weight of Zr. Multiplying this coefficient by the weight percent of Zr is made because 0.52Zr is equivalent to Ti in the relation to the amount of S.

The following explains the roles of the alloy components of the present free-cutting steel and the reasons for deciding the alloy composition.

C: 0.05–0.80%

A part of carbon is dissolved in Fe to ensure strength of the steel and the rest combines with Ti, Zr and S to form Ti-carbosulfide, which improves machinability in turning. At a C-content less than 0.05% this effect is not obtained. On the other hand, if the C-content exceeds the upper limit, 0.80%, resilience and machinability of the steel in turning will decrease.

Si: 0.01–2.5%

Silicon is added as a deoxidizing agent at steel making, and further, increases hardenability of the steel. Si-content less than 0.01% will not give this merit. If Si is added to the content more than 2.5%, resilience of the steel decreases and crack formation at plastic processing tends to occur.

Mn: 0.1–3.5%

Manganese, by combining with S, and if Ca and/or Mg exists, also with these elements, forms MnS, or (Mn,Ca)S, (Mn,Mg)S or (Mn,Ca,Mg)S to improve the machinability in drilling. To obtain this merit the Mn-content must be at least 0.1%. Too much content will, however, increases hardness of the steel and decreases the machinability in turning. The upper limit, 3.5%, is thus given.

Ti+0.52Zr: 0.03–1.2%

Both titanium and zirconium combine with carbon and sulfur to form carbosulfides, which contribute to improvement in machinability in turning. This effect may be obtained either in case where only Ti is added or where only Zr is added, and of course, in case where both are added. If Ti+0.52Zr is less than 0.03% the merit is not obtainable. The merit saturates at a higher content, and it will be disadvantageous from the viewpoint of manufacturing cost to use much amount of Ti and/or Zr. Thus, 1.2% is set to be the upper limit.

S: 0.015% up to 0.6%

A part of sulfur combines with Mn and, if Ca and/or Mg exists, also with these elements, to form MnS, or (Mn,Ca)S, (Mn,Mg)S or (Mn,Ca,Mg)S, which improves the machinability in drilling. The rest of S combines with Ti and/or Zr and C to form the carbosulfide, which contributes to improvement in machinability in turning. At S-content less than 0.015% this merit is not obtained, while a content over 0.6% causes significant decrease in hot workability.

The following explains the roles of the alloy components which are optionally added in addition to the above mentioned basic alloy components, and the reasons for limiting the composition ranges.

Ca: 0.0005–0.02%

Calcium dissolves in MnS to form (Mn,Ca)S or (Mn,Ca, Mg)S, which improves the machinability in drilling. Unless the content is not 0.0005% or more, the effect is not observed. At a content higher than 0.02% a substance of high melting point, CaS, is formed and this compound may cause a trouble of nozzle clogging at casting step of steel making.

Mg: 0.0003–0.02%

Magnesium also dissolves in MnS to form (Mn,Mg)S or (Mn,Ca,Mg)S, which improves the machinability in drilling. Unless the content is not 0.0003% or more, the effect is not observed. At a content higher than 0.02% productivity of melting and rolling in the steel making is remarkably lowered.

B: 0.0003–0.01%

Boron is a useful component for enhancing hardenability of the steel, and the effect is observed at such a low content as 0.0003%. Addition of much amount causes coarsening of crystal grains and crack formation at hot processing, and therefore, the addition is limited to at highest 0.01%.

Improvement in hardenability is often required to machine structural steels. Boron is often used for this purpose. Because the effect of B-addition is not available unless B is dissolved as free-B in the matrix, it is necessary to fix N and O, which tend to combine B to form compounds, with the other element or elements. In the present steel Ti fixes nitrogen. Oxygen will be fixed by Al, if the steel contains it.

Cr: up to 3.5%

Chromium is a useful component to enhance hardenability of the steel. Addition in a large amount is disadvantageous in respect to the manufacturing cost, and further, causes cracks during hot working. The amount of Cr-addition is thus at maximum 3.5%.

Ni: up to 4.0%

Nickel is, like chromium, a useful component for enhancing hardenability of the steel. Addition of Ni in a large amount is also disadvantageous in regard to the manufacturing cost, and further, causes decrease in machinability in turning. The content of Ni should be 4.0% or less.

Cu: up to 2.0%

Copper is an element which makes the structure fine and increases the strength of the steel. Too much addition results in decreased hot workability and machinability in turning. Thus, the addition should be in an amount up to 2.0%.

Se: 0.005–0.4%

Selenium is an effective component to improve machinability in turning. The effect is not obtainable with such a small amount of Se as less than 0.005%. An amount of addition more than 0.4% causes decrease in hot workability of the steel and occurrence of many cracks.

Mo: up to 2.0%

Molybdenum is, like chromium, a useful element for enhancing hardenability of the steel. Addition in a large amount is disadvantageous because of increased manufacturing cost, decreased machinability in turning, and occurrence of cracks at hot processing. The upper limit of content, 2.0%, was thus decided.

Te: 0.005–0.1%

Tellurium improves machinability in turning of the steel. This effect is not available at a content less than 0.005%. Increase in the content lowers hot workability of the steel to cause cracking at processing. The addition must be in an amount up to 0.1%

Pb: up to 0.4%

Lead is a component improving machinability in both turning and drilling. Pb exists in the steel solely or in the form of composites by adhesion to outer surfaces of sulfide inclusions, and due to its low melting point, Pb improves machinability in not only turning but also drilling. However, because of its high specific gravity excess Pb will precipitates and coagulates to form defects in the steel. The addition amount of Pb is thus limited up to 0.4%. In the cases where unfavorable influence to the environment is concerned, Pb is not used.

Bi: up to 0.4%

Bismuth has properties like those of lead, and can improve machinability both in turning and drilling. Excess Bi, also due to its high specific gravity, precipitates and coagulates to form defects in the steel. The amount of Bi-addition is thus limited to 0.4% or less.

Nb: up to 0.2%

Niobium is a component having the effect of preventing coarsening of crystal grains at high temperature. The effect saturates at a higher amount of addition and the content is limited to be 0.2% or less.

V: up to 0.2%

Vanadium, by combining with carbon to form the carbide, minutes crystal grains of the steel to increase toughness. Because the effect saturates at a higher amount of addition, V-content is limited to be up to 0.2%.

Ta: up to 0.5%

Tantalum is also effective in making crystal grains fine and increasing toughness of the steel. The effect saturates at a higher amount of addition, and Ta-content is thus limited to 0.5% or less.

The steel to which the present invention is applicable encompasses many steel marks. Practically important steel marks are, S45C (high carbon steel), S15C (low carbon steel), SCR420 (case hardening steel) and SCM440 (tough steel).

As explained above, the free-cutting steel of the invention exhibits good machinability both in turning and drilling due to carefully selected alloy components and establishment of the condition (Ti+0.52Zr)/S<2 that makes two kinds of inclusions, Ti-carbosulfide and MnS or (Mn,Ca,Mg)S, formed and dispersed in the steel matrix. Manufacturing machine parts with the steel according to the present invention realizes decrease in tool cost and increase in machining efficiency, and makes it possible to provide less expensive parts of various types.

EXAMPLES

Molten steels of the four steel marks mentioned above, S45C, S15C, SCR420 and SCM440, were prepared in a high frequency induction furnace and cast into ingots. The casted ingots were forged to round rods of diameter 90 mm, from which, after normalization at 850–900° C., test pieces for drilling tests (30×80 mm square) and test pieces for turning tests (diameter 90 mm) were cut off.

Drilling efficiency tests (LV1000) were carried out using the test pieces for drilling test under the following conditions.

Tool: SKH 51 (high speed steel)

Drill diameter: 5 mm

Feed: 0.1 mm/rev

Depth of hole: 2.0 mm (dead-end)

Cutting oil: dry

The recorded cutting speeds (m/min) at which the drill lives are 1000 mm are referred to as "drilling efficiency", which were taken as the indices for machinability in drilling. The larger the figure is, the better the machinability is.

On the other hand, turning life tests were carried out using the test pieces for turning and an NC-turning machine under the following conditions.

Tool: cemented carbide P10

Cutting Speed: 200 m/min

Feed: 0.2 mm/rev

Depth of cut: 2.0 mm

Cutting oil: dry

Turning periods until averaged flank abrasion at side clearance of the tools reach 100 $\mu$m were recorded as "turning life", which were taken as the indices for machinability in turning. The larger the figure is, the better the machinability is.

The alloy compositions (mass %, the balance being Fe), turning lives and drilling efficiencies are shown in the tables below.

The turning lives and the drilling efficiencies were compared with the data of conventional sulfur-free-cutting steels containing the same amounts of sulfur and, based on the comparison, the steels were evaluated as follows.

Yes: improvement appreciated

=: equal to that of the conventional steel

No: no improvement or worse result

From the data of Example 1 for S45C, Tables 1A to 2B, the following is concluded:

(1) Comparison of Working Examples 1–4, in which neither Ca nor Mg is contained, with Working Examples 5–7, which contain Ca or Mg, are compared, machinability in both turning and drilling can be said sufficiently improved in the latter. In Examples 8–11, to which a machinability-improving element or elements are added, machinabilities in both turning and drilling is high.

(2) All the Control Examples 1–6 and 11–14, in which the value (Ti+0.52Zr)/S is more than 2 exhibited lower machinability in drilling. Control Examples 9 and 10, both of which contain neither Ti nor Zr naturally have low machinability, particularly, in drilling. Of the Control Examples 11–14 improvement is observed only in the case of Pb-addition.

The same tendency can be observed in the data of the other Examples using the steels other than S45C. From these data, it is concluded that the condition of (Ti+0.52Zr)/S<2 is important and that addition of Ca and/or Mg is preferable.

TABLE 1A

| | | S45C | | Working Examples | | Alloy Compositions | | | | | |
|---|---|---|---|---|---|---|---|---|---|---|---|
| No. | C | Si | Mn | S | Ti/Zr | Ca/Mg | Cu | Ni | Cr | B | Others |
| 1 | 0.45 | 0.19 | 0.86 | 0.022 | Ti0.041 | — | 0.12 | 0.08 | 0.09 | 0.0013 | — |
| 2 | 0.40 | 0.09 | 0.75 | 0.046 | Ti0.033 | — | 0.18 | 0.05 | 0.20 | — | — |
| 3 | 0.42 | 0.20 | 0.66 | 0.173 | Ti0.201 | — | 0.54 | 0.06 | 0.18 | — | V0.10 |
| 4 | 0.39 | 0.18 | 0.74 | 0.046 | Zr0.088 | — | 0.11 | 0.10 | 0.12 | 0.0015 | — |
| 5 | 0.42 | 0.19 | 0.73 | 0.042 | Ti0.069 Zr0.069 | Ca0.0014 | 0.05 | 0.04 | 0.12 | 0.0015 | — |
| 6 | 0.43 | 0.18 | 0.73 | 0.043 | Ti0.014 | Ca0.0018 | 0.18 | 0.03 | 0.12 | 0.0012 | Nb0.03 |
| 7 | 0.48 | 0.22 | 0.73 | 0.050 | Zr0.143 | Mg0.0018 | 0.23 | 0.06 | 0.08 | — | — |
| 8 | 0.44 | 0.18 | 0.81 | 0.033 | Ti0.040 | — | 0.08 | 0.04 | 0.11 | 0.0010 | Se0.051 |
| 9 | 0.43 | 0.22 | 0.74 | 0.051 | Ti0.087 | — | 0.05 | 0.02 | 0.08 | 0.0011 | Te0.06 |
| 10 | 0.46 | 0.33 | 0.67 | 0.045 | Ti0.076 | — | 0.25 | 0.06 | 0.13 | 0.0008 | Pb0.07 |
| 11 | 0.47 | 0.29 | 0.73 | 0.052 | Ti0.077 | — | 0.18 | 0.09 | 0.17 | 0.0009 | Bi0.04 |

TABLE 1B

| No. | S45C (Ti + 0.52 Zr)/S | Working Examples Turning VB100 | Working Examples Tool Life Improvement | Test Results Drilling VL1000 | Test Results Efficiency Improvement |
|---|---|---|---|---|---|
| 1 | 1.86 | 4.1 | Yes | 49.2 | = |
| 2 | 0.72 | 7.3 | Yes | 55.7 | = |
| 3 | 1.16 | 13.8 | = | 89.2 | Yes |
| 4 | 0.99 | 5.0 | = | 56.8 | Yes |
| 5 | 1.64 | 57.2 | Yes | 57.7 | Yes |
| 6 | 1.16 | 52.9 | Yes | 59.7 | Yes |
| 7 | 1.49 | 55.3 | Yes | 62.2 | Yes |
| 8 | 0.83 | 11.2 | Yes | 77.2 | Yes |
| 9 | 1.71 | 17.8 | Yes | 80.3 | Yes |
| 10 | 1.69 | 20.3 | Yes | 81.6 | Yes |
| 11 | 1.48 | 17.6 | Yes | 76.6 | Yes |

TABLE 2B-continued

| No. | S45C (Ti + 0.52 Zr)/S | Control Examples Turning VB100 | Control Examples Tool Life Improvement | Test Results Drilling VL1000 | Test Results Efficiency Improvement |
|---|---|---|---|---|---|
| 3 | 5.00 | 13.9 | Yes | 45.5 | No |
| 4 | 2.31 | 5.6 | Yes | 34.6 | No |
| 5 | 3.01 | 20.3 | Yes | 45.6 | No |
| 6 | 2.67 | 23.0 | = | 67.1 | No |
| 7 | 3.24 | 18.1 | Yes | 57.3 | No |
| 8 | 5.45 | 13.2 | Yes | 45.0 | No |
| 9 | 0 | 4.9 | = | 48.1 | No |
| 10 | 0 | 53.9 | Yes | 50.6 | = |
| 11 | 4.09 | 8.2 | Yes | 57.1 | = |
| 12 | 4.32 | 11.4 | Yes | 63.2 | = |

TABLE 2A

| No. | S45C C | S45C Si | S45C Mn | Control Examples S | Control Examples Ti/Zr | Alloy Compositions Ca/Mg | Alloy Compositions Cu | Alloy Compositions Ni | Alloy Compositions Cr | Alloy Compositions B | Alloy Compositions Others |
|---|---|---|---|---|---|---|---|---|---|---|---|
| 1 | 0.47 | 0.09 | 0.65 | 0.033 | Ti0.089 | — | 0.21 | 0.04 | 0.14 | — | — |
| 2 | 0.38 | 0.28 | 0.96 | 0.073 | Ti0.235 | — | 0.19 | 0.12 | 0.29 | 0.0017 | — |
| 3 | 0.50 | 0.18 | 1.02 | 0.059 | Ti0.293 | Ca0.0017 | 0.56 | 0.09 | 0.12 | 0.0009 | — |
| 4 | 0.49 | 0.33 | 0.91 | 0.029 | Zr0.067 | — | 0.23 | 0.03 | 0.15 | — | V0.11 |
| 5 | 0.44 | 0.34 | 0.77 | 0.052 | Ti0.051 Zr0.203 | Mg0.0011 | 0.10 | 0.09 | 0.13 | 0.0011 | — |
| 6 | 0.43 | 0.22 | 0.89 | 0.176 | Ti0.47 | — | 0.12 | 0.02 | 0.09 | 0.0021 | — |
| 7 | 0.43 | 0.11 | 0.68 | 0.102 | Zr0.33 | — | 0.15 | 0.12 | 0.19 | — | Nb0.04 |
| 8 | 0.45 | 0.21 | 0.85 | 0.029 | Ti0.158 | Ca0.0012 | 0.06 | 0.02 | 0.08 | 0.0012 | — |
| 9 | 0.46 | 0.25 | 0.75 | 0.056 | — | — | 0.22 | 0.05 | 0.12 | 0.0015 | — |
| 10 | 0.42 | 0.24 | 0.87 | 0.044 | — | Ca0.0011 Mg0.006 | 0.04 | 0.03 | 0.09 | — | — |
| 11 | 0.45 | 0.22 | 0.65 | 0.043 | Ti0.176 | — | 0.12 | 0.04 | 0.18 | 0.0090 | Se0.059 |
| 12 | 0.43 | 0.31 | 0.73 | 0.065 | Ti0.281 | — | 0.19 | 0.09 | 0.21 | 0.0018 | Te0.06 |
| 13 | 0.44 | 0.19 | 0.81 | 0.053 | Ti0.165 | — | 0.16 | 0.10 | 0.16 | 0.0015 | Pb0.08 |
| 14 | 0.47 | 0.23 | 0.88 | 0.057 | Ti0.205 | — | 0.09 | 0.06 | 0.11 | 0.0013 | Bi0.04 |

TABLE 2B

| No. | S45C (Ti + 0.52 Zr)/S | Control Examples Turning VB100 | Control Examples Tool Life Improvement | Test Results Drilling VL1000 | Test Results Efficiency Improvement |
|---|---|---|---|---|---|
| 1 | 2.70 | 6.4 | Yes | 40.1 | No |
| 2 | 3.20 | 14.5 | Yes | 41.8 | No |

TABLE 2B-continued

| No. | S45C (Ti + 0.52 Zr)/S | Control Examples Turning VB100 | Control Examples Tool Life Improvement | Test Results Drilling VL1000 | Test Results Efficiency Improvement |
|---|---|---|---|---|---|
| 13 | 3.11 | 19.1 | Yes | 68.9 | Yes |
| 14 | 3.60 | 18.9 | Yes | 61.2 | = |

TABLE 3A

| No. | S15C C | S15C Si | S15C Mn | Working Examples S | Working Examples Ti/Zr | Alloy Compositions Ca/Mg | Alloy Compositions Cu | Alloy Compositions Ni | Alloy Compositions Cr | Alloy Compositions B | Alloy Compositions Others |
|---|---|---|---|---|---|---|---|---|---|---|---|
| 1 | 0.14 | 0.22 | 0.87 | 0.018 | Ti0.032 | Ca0.0011 | 0.13 | 0.11 | 0.21 | — | — |
| 2 | 0.12 | 0.29 | 0.59 | 0.051 | Ti0.088 | — | 0.21 | 0.09 | 0.08 | 0.0011 | — |
| 3 | 0.19 | 0.10 | 0.83 | 0.105 | Ti0.123 | — | 0.22 | 0.11 | 0.11 | 0.0023 | — |
| 4 | 0.20 | 0.24 | 0.91 | 0.145 | Ti0.121 | — | 0.10 | 0.21 | 0.05 | 0.0015 | — |

TABLE 3B

| No. | S15C (Ti + 0.52 Zr)/S | Working Examples Turning VB100 | Working Examples Tool Life Improvement | Test Results Drilling VL1000 | Test Results Efficiency Improvement |
|---|---|---|---|---|---|
| 1 | 1.78 | 28.9 | Yes | 72.6 | Yes |
| 2 | 1.73 | 23.9 | Yes | 79.8 | Yes |
| 3 | 1.17 | 40.6 | = | 98.3 | Yes |
| 4 | 0.83 | 72.3 | Yes | 102.6 | = |

TABLE 4A

| No. | S15C C | S15C Si | S15C Mn | Control Examples S | Control Examples Ti/Zr | Alloy Compositions Ca/Mg | Alloy Compositions Cu | Alloy Compositions Ni | Alloy Compositions Cr | Alloy Compositions B | Alloy Compositions Others |
|---|---|---|---|---|---|---|---|---|---|---|---|
| 1 | 0.13 | 0.19 | 0.87 | 0.021 | Ti0.156 | Ca0.0032 | 0.18 | 0.02 | 0.07 | — | — |
| 2 | 0.18 | 0.09 | 0.67 | 0.056 | Ti0.239 | — | 0.09 | 0.11 | 0.12 | 0.0014 | — |
| 3 | 0.15 | 0.16 | 1.00 | 0.111 | Ti0.512 | — | 0.11 | 0.04 | 0.08 | 0.0018 | — |
| 4 | 0.14 | 0.31 | 0.57 | 0.163 | Ti0.481 | — | 0.17 | 0.07 | 0.09 | 0.0009 | — |

TABLE 4B

| No. | S15C (Ti + 0.52 Zr)/S | Control Examples Turning VB100 | Control Examples Tool Life Improvement | Test Results Drilling VL1000 | Test Results Efficiency Improvement |
|---|---|---|---|---|---|
| 1 | 7.43 | 26.7 | Yes | 53.4 | No |
| 2 | 4.27 | 34.5 | Yes | 60.4 | No |
| 3 | 4.61 | 59.5 | Yes | 68.6 | No |
| 4 | 2.95 | 80.4 | Yes | 70.1 | No |

TABLE 5A

| No. | SCR420 C | SCR420 Si | SCR420 Mn | Working Examples S | Working Examples Ti/Zr | Alloy Compositions Cu | Alloy Compositions Ni | Alloy Compositions Cr | Alloy Compositions Nb | Alloy Compositions B | Alloy Compositions Others |
|---|---|---|---|---|---|---|---|---|---|---|---|
| 1 | 0.21 | 0.15 | 0.87 | 0.033 | Ti0.047 | 0.05 | 0.09 | 1.82 | — | — | — |
| 2 | 0.21 | 0.22 | 0.67 | 0.067 | Ti0.072 | 0.12 | 0.11 | 1.56 | — | 0.0013 | — |
| 3 | 0.19 | 0.18 | 0.81 | 0.122 | Ti0.111 | 0.23 | 0.06 | 2.02 | — | 0.0008 | — |
| 4 | 0.18 | 0.09 | 0.54 | 0.023 | Ti0.033 | 0.18 | 0.03 | 2.13 | 0.02 | 0.0016 | — |

TABLE 5B

| No. | SCR420 (Ti + 0.52 Zr)/S | Working Examples Turning VB100 | Working Examples Tool Life Improvement | Test Results Drilling VL1000 | Test Results Efficiency Improvement |
|---|---|---|---|---|---|
| 1 | 1.42 | 9.8 | Yes | 69.3 | Yes |
| 2 | 1.07 | 16.8 | Yes | 84.6 | Yes |
| 3 | 0.91 | 23.2 | = | 93.9 | Yes |
| 4 | 1.43 | 8.6 | Yes | 71.5 | Yes |

TABLE 6A

| | SCR420 | | | Control Examples | | | Alloy Compositions | | | | |
|---|---|---|---|---|---|---|---|---|---|---|---|
| No. | C | Si | Mn | S | Ti/Zr | Cu | Ni | Cr | Nb | B | Others |
| 1 | 0.23 | 0.12 | 0.77 | 0.019 | Ti0.122 | 0.08 | 0.12 | 2.21 | — | — | — |
| 2 | 0.15 | 0.12 | 0.64 | 0.045 | Ti0.179 | 0.17 | 0.05 | 1.88 | — | 0.0018 | — |
| 3 | 0.19 | 0.22 | 0.72 | 0.108 | Ti0.332 | 0.26 | 0.04 | 1.65 | — | 0.0011 | — |
| 4 | 0.18 | 0.08 | 0.49 | 0.024 | Ti0.083 | 0.21 | 0.02 | 2.00 | 0.02 | 0.0015 | — |

TABLE 6B

| | SCR420 | Control Examples | | Test Results | |
|---|---|---|---|---|---|
| No. | (Ti + 0.52 Zr)/S | Turning VB100 | Tool Life Improvement | Drilling VL1000 | Efficiency Improvement |
| 1 | 6.42 | 11.3 | Yes | 50.1 | No |
| 2 | 3.98 | 15.6 | Yes | 54.4 | No |
| 3 | 3.07 | 27.9 | Yes | 70.6 | No |
| 4 | 3.46 | 10.2 | Yes | 50.3 | No |

TABLE 7A

| | SCM440 | | | Working Examples | | | Alloy Compositions | | | | |
|---|---|---|---|---|---|---|---|---|---|---|---|
| No. | C | Si | Mn | S | Ti/Ca | Cu | Ni | Cr | Mo | B | Others |
| 1 | 0.39 | 0.33 | 0.86 | 0.023 | Ti0.033 | 0.12 | 0.03 | 1.12 | 0.10 | 0.0012 | — |
| 2 | 0.43 | 0.24 | 0.91 | 0.054 | Ti0.074 | 0.24 | 0.04 | 2.21 | 0.41 | 0.0016 | — |
| 3 | 0.41 | 0.29 | 0.85 | 0.097 | Ti0.156 | 0.15 | 0.09 | 1.89 | 0.22 | 0.0007 | — |
| 4 | 0.40 | 0.22 | 0.67 | 0.045 | Ti0.044 | 0.04 | 0.08 | 2.06 | 0.12 | — | Ca0.0021 |

TABLE 7B

| | SCM440 | Working Examples | | Test Results | |
|---|---|---|---|---|---|
| No. | (Ti + 0.52 Zr)/S | Turning VB100 | Tool Life Improvement | Drilling VL1000 | Efficiency Improvement |
| 1 | 1.43 | 3.4 | Yes | 48.2 | Yes |
| 2 | 1.37 | 5.6 | Yes | 53.4 | Yes |
| 3 | 1.61 | 7.5 | Yes | 61.5 | Yes |
| 4 | 0.98 | 18.3 | Yes | 52.2 | Yes |

TABLE 8A

| | SCM440 | | | Control Examples | | | Alloy Compositions | | | | |
|---|---|---|---|---|---|---|---|---|---|---|---|
| No. | C | Si | Mn | S | Ti/Zr | Cu | Ni | Cr | Mo | B | Others |
| 1 | 0.38 | 0.28 | 0.64 | 0.036 | Ti0.145 | 0.11 | 0.03 | 2.22 | 0.32 | 0.0023 | — |
| 2 | 0.42 | 0.19 | 1.00 | 0.055 | Ti0.233 | 0.25 | 0.03 | 1.56 | 0.19 | 0.0011 | — |
| 3 | 0.41 | 0.35 | 0.76 | 0.121 | Ti0.548 | 0.15 | 0.06 | 2.03 | 0.12 | 0.0017 | — |
| 4 | 0.40 | 0.27 | 0.79 | 0.052 | Ti0.192 | 0.06 | 0.12 | 1.98 | 0.18 | — | Ca0.0011 |

TABLE 8B

| | SCM440 | Control Examples | | Test Results | |
|---|---|---|---|---|---|
| No. | (Ti + 0.52 Zr)/S | Turning VB100 | Tool Life Improvement | Drilling VL1000 | Efficiency Improvement |
| 1 | 4.03 | 5.8 | Yes | 34.6 | No |
| 2 | 4.24 | 9.8 | Yes | 43.1 | = |
| 3 | 4.53 | 15.7 | Yes | 50.1 | No |
| 4 | 3.69 | 17.5 | Yes | 39.2 | No |

What is claimed is:

1. A free-cutting steel consisting essentially of, in mass %, C: 0.05–0.80%, Si: 0.01–2.5%, Mn: 0.1–3.5%, Ti+0.52Zr: 0.03–1.2%, S: 0.015–0.6%, Ni: 0.02–4.0%, Cr: 0.05–3.5%, and the balance of Fe and inevitable impurities, wherein the contents of Ti, Zr and S meet the condition of $0.72 \leqq (Ti+0.52Zr)/S<2$.

2. The free-cutting steel according to claim 1, wherein the steel further contains one or both of Ca: 0.0005–0.02% and Mg: 0.0003–0.02%.

3. The free-cutting steel according to claim 1, wherein the steel further contains B: 0.0003–0.01%.

4. The free-cutting steel according to claim 1, wherein the steel further contains one or more of the group consisting of Cu: up to 2.0%, and Mo: up to 2.0%.

5. The free-cutting steel according to claim 1, wherein the steel further contains one or more of the group consisting of Se: 0.005–0.4%, Pb: up to 0.4% and Bi: up to 0.4%.

6. The free-cutting steel according to claim 1, wherein the steel further contains one or more of the group consisting of V: up to 0.2%, Nb: up to 0.2% and Ta: up to 0.5%.

7. A free-cutting steel consisting essentially of, in mass %, 0.05–0.80% of C,: 0.01–2.5% of Si, 0.1–3.5% of Mn, 0.03–1.2% of Ti+0.52Zr, 0.015–0.6% of S, Ni: 0.02–4.0%, Cr: 0.05–3.5%, free of Te, and the balance of Fe and inevitable impurities, wherein the contents of Ti, Zr and S meet the condition of $0.72 \leqq (Ti+0.52Zr)/S<2$.

* * * * *